US005215720A

United States Patent [19]

Cetinkaya

[11] Patent Number: 5,215,720

[45] Date of Patent: Jun. 1, 1993

[54] CONVERSION OF SIDE BY SIDE FCC UNIT

[75] Inventor: Ismail B. Cetinkaya, Palatine, Ill.

[73] Assignee: UOP, Des Plaines, Ill.

[21] Appl. No.: 662,655

[22] Filed: Mar. 1, 1991

Related U.S. Application Data

[62] Division of Ser. No. 525,018, May 18, 1990, Pat. No. 5,013,425.

[51] Int. Cl.[5] ..... B01J 38/34; B01J 38/30; B01J 38/12; B01J 8/24

[52] U.S. Cl. ..... 422/144; 422/145; 422/147; 29/401.1; 29/469; 29/426.2

[58] Field of Search ..... 29/401.1, 469, 426.2; 422/144, 145, 147

[56] References Cited

U.S. PATENT DOCUMENTS

| | | | |
|---|---|---|---|
| 2,717,439 | 9/1955 | Bergstrom | 29/469 |
| 3,274,745 | 9/1966 | McManus et al. | 29/469 |
| 3,844,973 | 10/1974 | Stine et al. | 502/42 |
| 3,923,606 | 12/1975 | Hauster | 203/7 |
| 3,926,778 | 12/1975 | Owen et al. | 208/74 |
| 3,926,843 | 12/1975 | Owen | 502/42 |
| 3,958,953 | 5/1976 | Luckenbach | 422/144 |
| 4,064,038 | 12/1977 | Vermilion, Jr. | 208/120 |
| 4,299,687 | 11/1981 | Myers et al. | 208/113 |
| 4,336,103 | 6/1982 | Katscher et al. | 376/245 |
| 4,615,992 | 10/1986 | Murphy | 502/41 |
| 4,789,458 | 12/1988 | Haddad et al. | 208/151 |
| 4,859,424 | 8/1989 | Cabrera | 29/401.1 X |
| 4,875,993 | 10/1989 | Mauleon et al. | 208/113 |
| 4,875,994 | 10/1989 | Haddad et al. | 208/113 |

*Primary Examiner*—Robert J. Warden
*Assistant Examiner*—Stephanie Blythe
*Attorney, Agent, or Firm*—Thomas K. McBride; John G. Tolomei

[57] ABSTRACT

A method of converting a side by side FCC arrangement adds a new reactor vessel and uses the regenerator vessel and reactor vessel to provide a regeneration section having at least three stages of regeneration that is used as part of an enlarged FCC process. In simplest form, the conversion method calls for the use of the regeneration vessel as a first-stage regeneration zone, the use of the reactor vessel as a second-stage regeneration zone, and the use of the spent catalyst stripper as a third stage of regeneration. This arrangement provides a second stage of regeneration that is positioned to facilitate the addition of partially regenerated catalyst to the stripping zone to facilitate the operation of a hot catalyst stripping section.

2 Claims, 2 Drawing Sheets

CONVERSION OF SIDE BY SIDE FCC UNIT

CROSS-REFERENCE TO RELATED APPLICATIONS

This application is a division of U.S. patent application Ser. No. 525,018, filed May 18, 1990, now U.S. Pat. No. 5,013,425.

BACKGROUND OF THE INVENTION

1. Field of the Invention

This invention relates to the fluidized catalytic cracking (FCC) conversion of heavy hydrocarbons into lighter hydrocarbons with a fluidized stream of catalyst particles and regeneration of the catalyst particles to remove coke which acts to deactivate the catalyst. More specifically, this invention relates to the apparatus for performing the FCC process.

2. Description of the Prior Art

Catalytic cracking is accomplished by contacting hydrocarbons in a reaction zone with a catalyst composed of finely divided particulate material. The reaction in catalytic cracking, as opposed to hydrocracking, is carried out in the absence of added hydrogen or the consumption of hydrogen. As the cracking reaction proceeds, substantial amounts of coke are deposited on the catalyst. A high temperature regeneration within a regeneration zone operation burns coke from the catalyst. Coke-containing catalyst, referred to herein as spent catalyst, is continually removed from the reaction zone and replaced by essentially coke-free catalyst from the regeneration zone. Fluidization of the catalyst particles by various gaseous streams allows the transport of catalyst between the reaction zone and regeneration zone. Methods for cracking hydrocarbons in a fluidized stream of catalyst, transporting catalyst between reaction and regeneration zones, and combusting coke in the regenerator are well known by those skilled in the art of FCC processes. To this end, the art is replete with vessel configurations for contacting catalyst particles with feed and regeneration gas, respectively.

One well known configuration of FCC unit that gained wide acceptance during the 1960's is a side by side FCC reactor and regenerator. This design comprises a reactor vessel including an upper reaction zone and a subadjacent stripping zone located to the side of a regenerator vessel that contains a single stage regeneration zone. Regenerated catalyst flows from the regeneration vessel through a regenerator standpipe into a riser where it contacts an FCC charge stock. Expanding gases from the charge stock and fluidizing medium convey the catalyst up an external riser and into the reactor vessel. Cyclone separators in the reactor divide the catalyst from reacted feed vapors which pass into an upper recovery line while the catalyst collects in the bottom of the reactor. A stripping zone, formed as a lower part of the reactor vessel, receives spent catalyst from the reaction zone. Steam rises from the bottom of the stripper, countercurrent to the downward flow catalyst, and removes sorbed hydrocarbons from the catalyst. Spent catalyst continues its downward movement from the stripper vessel through a reactor standpipe and into a dense fluidized catalyst bed contained within the regeneration vessel. Coke on the spent catalyst reacts with oxygen in an air stream that ascends through the regeneration vessel and ultimately becomes spent regeneration gas. Again, cyclone separators at the top of the regenerator return catalyst particles to the dense bed and deliver a relatively catalyst-free regeneration gas to an overhead gas conduit.

Changes in regeneration technique, types of available feedstock, and higher throughput requirements have greatly diminished the utility and viability of these stacked arrangements. Since the introduction of the side by side FCC arrangement, two particularly useful additions to regeneration technique include multiple-stage regeneration and the addition of means to remove heat from the regenerator. The major impetus for adopting these changes is the need to improve conversion of a wide variety of feedstocks.

Optimization of feedstock conversion ordinarily requires essentially complete removal of coke from the catalyst. This essentially complete removal of coke from catalyst is often referred to as complete regeneration. Complete regeneration produces a catalyst having less than 0.1 and preferably less than 0.05 wt. % coke. In order to obtain complete regeneration, oxygen in excess of the stoichiometric amount necessary for the combustion of coke to carbon oxides is charged to the regenerator. When a complete combustion of coke occurs the spent regeneration gas contains 1–10% excess oxygen. Excess oxygen in the regeneration zone will also react with carbon monoxide produced by the combustion of coke thereby yielding a further evolution of heat. When CO combustion occurs in a relatively catalyst-free zone of the regenerator, such as the region above the dense fluidized bed in a single regenerator vessel, the resulting high temperatures may lead to severe equipment damage. Such situations may be avoided if the CO combustion takes place in the presence of catalyst particles which act as a heat sink. Therefore, regenerators are generally designed to avoid the combination of free oxygen and carbon monoxide in regions that are relatively free of catalyst. Despite this, the heat evolved from unintended CO combustion may raise the temperature of the catalyst to the point of causing thermal deactivation of the catalyst or may affect the process by limiting the amount of catalyst that can contact the feedstock. The problems of controlling catalyst and regenerator temperatures are exacerbated by the application of FCC processes to crack heavy feedstocks. With the increased coke producing tendencies of these heavy or residual feeds, a complete regeneration of catalyst becomes more difficult due to the excessive heat evolution associated with coke and CO combustion. A common approach to minimizing CO combustion while yet obtaining fully regenerated catalyst has been to perform the regeneration in stages.

Another aspect of FCC operation that is receiving increased attention is spent catalyst stripping. After the catalyst has contacted the feed and prior to its entering the regenerator, the spent catalyst is contacted with steam to prevent the entrainment of hydrocarbon containing gases with the catalyst as it enters the regenerator and to desorb condensed hydrocarbons from the surface of the catalyst. It is now believed that a significant amount of hydrocarbons remain adsorbed on the catalyst as it enters the regeneration zone. The presence of these sorbed hydrocarbons present a two-fold disadvantage in that it reduces potential product yields as well as introducing additional combustible material into the regenerator and thereby raising the temperature of the regeneration zone during coke combustion.

It has been recognized that raising the temperature of the stripping zone can lead to improved stripping results. A convenient source of heat for the stripping zone is the hot regenerated catalyst from the regeneration zone. When mixed in the stripping zone, the much higher temperature of the regenerated catalyst relative to the spent catalyst raises the temperature of the overall temperature of the stripping zone. The higher temperature volatizes condensed hydrocarbons from the surface of the catalyst thereby excluding combustible hydrocarbons from the regenerator and increasing the product yield.

There are drawbacks to the use of fresh regenerated catalyst in the catalyst stripper. The main drawback is the concern that introduction of fresh catalyst into the spent catalyst, steam and hydrocarbon environment of the stripping zone will damage the catalyst or present clean catalyst surfaces that can cause a further loss in hydrocarbon product. Damage to the regenerated catalyst can result from the high temperature steam exposure in the catalyst stripping zone. The very clean regenerated catalyst that enters the stripping zone is highly active so that it may further crack hydrocarbons in the stripping zone or its relatively high surface area can re-adsorb some of the hydrocarbons present in the stripping zone.

INFORMATION DISCLOSURE

Staged regeneration systems are well known in the regeneration of FCC catalyst. Luckenbach, U.S. Pat. No. 3,958,953, describes a staged flow system having concentric catalyst beds separated by baffles which open into a common space for collecting spent regeneration gas and separating catalyst particles. Myers et al., in U.S. Pat. No. 4,299,687, teach the use of a staged regenerator system having superimposed catalyst beds wherein spent catalyst particles first enter an upper dense fluidized bed of catalyst and are contacted with regeneration gas from the lower catalyst bed and fresh regeneration gas. After partial regeneration in the first regeneration zone, catalyst particles are transferred by gravity flow into a lower catalyst bed to which is charged a stream of fresh regeneration gas. Myers is directed to the processing of residual feeds and uses the two-stage regeneration process to limit CO combustion thereby reducing overall heat output within the regenerator.

The use of relatively dilute phase regeneration zones to effect complete catalyst regeneration is shown by Stine et al. in U.S. Pat. Nos. 3,844,973 and 3,923,606. Stine et al. seeks primarily to effect complete CO combustion for air pollution, thermal efficiency, and equipment minimization reasons by using increased gas velocities to transport catalyst through dense bed and relatively dilute phase regeneration zones. A two-stage system which combines a relatively dilute phase transport zone with a dense bed zone for regenerating catalyst used in cracking residual feeds is shown by Dean et al. in U.S. Pat. No. 4,336,103. In Dean, a first dense bed is used to initiate coke combustion in a lower portion of a regeneration section which is followed by an upper dilute phase regeneration section operating at high severity to complete regeneration and combustion of carbon monoxide. Dean's method uses a modified version of a stacked FCC configuration wherein the dense regeneration portion is the regeneration vessel of the stacked configuration and the dilute phase regeneration takes place in an additional vessel located to the side of the stacked configuration.

The use of fully or partially regenerated catalyst to heat a catalyst stripping zone is taught in U.S. Pat. No. 4,875,994, issued to Haddad et. al., and U.S. Pat. No. 4,875,993, issued to Mauleon et. al.

Since the side by side type FCC arrangements were normally designed to operate with only a single stage of regeneration, the side by side arrangement in its present form cannot accommodate two-stage regeneration. The perceived need for extensive modification greatly reduces the viability of the existing, side by side FCC configurations. Furthermore, it is common to find side by side FCC units where the single stage of regeneration operates in a partial CO combustion mode. Typically, when operated for partial CO combustion, the regeneration vessel will contain equipment that is unsuitable for the higher temperatures that accompany complete CO regeneration. The need to upgrade equipment in many side by side FCC configurations for present day operating practice further reduces the current utility of these units.

A number of side by side configurations have been upgraded to accommodate higher operating temperature. Common approaches to this type of upgrading include the replacement of internal equipment with more heat resistant equipment and the use of internal insulation or external convection devices to reduce the skin temperature of metal components such as conduits and vessel shells. In this regard, it is commonly found that the metallurgy of old reactor vessels is unsuitable for the increased reactor temperatures that are now preferred. The limitation on reactor temperature places a constraint on conversion and provides an incentive to refiners to replace the reactor vessel.

The present invention provides a method for utilizing a majority of the existing structures associated with a side by side FCC arrangement as part of a new FCC configuration having three stages of regeneration. This conversion also allows the owner of an existing side by side FCC configuration to greatly increase the processing capacity of the unit, including the processing of heavier feedstocks, while minimizing capital expenditure for new equipment. Minimization of capital expenditure is achieved by utilization of the reactor vessel, regeneration vessel and stripper vessel from the side by side configuration.

SUMMARY OF THE INVENTION

This invention, in one aspect, is a method of converting a side by side FCC arrangement to a regenerator having at least three stages of regeneration that is used as part of an enlarged FCC process. In simplest form, the conversion method calls for the use of the regeneration vessel as a first-stage regeneration zone, the use of the reactor vessel as a second-stage regeneration zone, and the use of the reactor stripper as a third stage of regeneration.

Accordingly, in one embodiment, this invention is a method of converting a side by side reactor/regenerator arrangement into a three-stage regenerator. The side by side reactor/regenerator arrangement for an FCC unit has a regeneration vessel, a first reactor vessel located to the side of the regeneration vessel, an external conduit for withdrawing catalyst from a lower portion of the regenerator vessel and a riser conduit for transporting catalyst upwardly into the reactor vessel. Means are provided for adding spent catalyst to the regeneration vessel and for recovering regeneration gas from an upper portion of the regeneration vessel. The arrangement also includes a stripping vessel subadjacent to and in open communication with the reactor vessel. The conversion method includes the steps of adding means for injecting an oxygen containing gas into the lower end of the riser conduit and lifting catalyst into the reactor vessel, which is modified to function as a second-stage regeneration vessel by providing means for distributing catalyst across a lower portion of the reactor vessel and providing means for recovering regeneration gas from the upper end of the reactor vessel. The stripping vessel is modified to function as a third-stage regeneration zone by installing means for distributing an oxygen-containing gas into a lower portion of the stripping vessel and providing means for collecting regenerated catalyst in the bottom of the stripping vessel and communicating the catalyst collection means with a catalyst withdrawal conduit for transferring catalyst from the stripping vessel to the regeneration vessel. A withdrawal conduit is also provided in the stripping vessel for withdrawing catalyst.

In another aspect, this invention includes the addition of a new side reactor vessel to the reactor and regeneration arrangement. The new reactor vessel has a subadjacent stripping vessel and a riser conduit that provides the reactor function of the converted reactor vessel. A conduit is provided between the subadjacent stripper of the new reactor vessel and the second-stage regeneration zone to supply partially regenerated catalyst to the stripping zone.

In another embodiment, this invention is an arrangement for a fluidized catalytic cracking unit. The unit comprises a first regeneration vessel having an open interior that provides a first regeneration zone, a distributor located in a lower portion of the first regeneration zone for distributing regeneration gas over the cross-section of the regeneration zone, means in an upper section of the regeneration zone for separating catalyst from flue gas and withdrawing flue gas from the regeneration zone, a first catalyst outlet nozzle communicating with a lower section of the regeneration zone and a first catalyst inlet nozzle in communication with the regeneration zone. A second regeneration vessel is spaced horizontally apart from the first regeneration vessel and houses a second regeneration zone located at a higher elevation than the first regeneration zone and a third regeneration zone located subadjacent to and in open communication with the second regeneration zone. The second regeneration zone has means in its upper section for separating catalyst from flue gas and withdrawing flue gas therefrom. The third regeneration zone has a plurality of baffles for contacting catalyst, means for distributing regeneration gas across its lower portion and a second catalyst outlet nozzle in its lower portion. A reactor vessel houses a collection zone in an upper portion of the vessel and a subadjacent stripping zone in a lower portion of the vessel. The collection zone has means for separating product vapors from catalyst and withdrawing product vapors from the reaction vessel. The stripping zone has a plurality of vertically spaced baffles for contacting catalyst, means for distributing a stripping gas to a lower portion of the stripping zone and a third catalyst outlet nozzle. An elongated regenerated catalyst riser has a second inlet nozzle at its lower end for communicating with the first outlet nozzle, means for injecting an oxygen-containing gas into its lower end and an outlet at its upper end that discharges into the second regeneration zone. The arrangement also has an elongated reactor riser that has a third catalyst inlet nozzle at its lower end that communicates with the second outlet nozzle, means for injecting an FCC feedstream into a lower section of the reactor riser and an outlet at its upper end that discharges into the collection zone.

In yet another embodiment, this invention is a process for the fluidized catalytic cracking of an FCC feedstock. The process comprises contacting an FCC feedstock with regenerated catalyst in an upstream section of a reactor riser and passing the catalyst and feedstock mixture through the riser to crack the hydrocarbons and produce product vapors while depositing coke on the catalyst. The coke-containing catalyst and the product vapors are discharged from the riser. The coke-containing catalyst is separated from the product vapors and the product vapors are recovered while the coke-containing catalyst is passed downwardly into a catalyst stripping zone. The coke-containing catalyst is contacted with a stripping gas in the stripping zone to separate additional product vapors from the catalyst. The stripped coke-containing catalyst is passed out of the stripping zone and collected in a first regeneration zone and contacted with an oxygen-containing gas to initiate combustion of the coke. Combustion of the coke produces a first flue gas stream that contains gaseous products of coke combustion. A dense bed of catalyst particles is maintained in the first regeneration zone and the catalyst particles are separated from the flue gas stream so that a flue gas stream is withdrawn from an upper portion of the regeneration zone and initially regenerated catalyst is withdrawn from a lower portion of the regeneration zone. The initially regenerated catalyst is passed from the regeneration zone to a regenerator riser and contacted with an oxygen-containing gas stream that carries the catalyst through the riser and discharges it into a second regeneration zone. Coke is combusted from the catalyst in the second regeneration zone to provide partially regenerated catalyst and to produce a second flue gas stream. Catalyst is separated from the second flue gas stream and the second flue gas stream is withdrawn from the second regeneration zone. Partially regenerated catalyst from the second regeneration zone passes downwardly into a third regeneration zone. Catalyst in the third regeneration zone continues to pass downwardly through a plurality of vertically spaced baffles while it is contacted countercurrently with an upwardly flowing oxygen-containing gas. The upwardly flowing oxygen-containing gas effects a nearly complete combustion of coke from the surface of the catalyst particles which are then passed to the reactor riser in the manner previously described. A third flue gas stream resulting from the combustion of coke in the third regeneration zone passes upwardly out of the third regeneration zone.

Other embodiments and aspects of the present invention encompass further details related to the replacement and addition of equipment to effect modification of the unit and the structure and operation of a unit modified in accordance with this invention.

DETAILED DESCRIPTION OF THE INVENTION

The present invention, in its method aspects, consists of steps for changing the function of an existing side by side FCC arrangement. Arrangements to which this method can be applied will have a single regeneration zone and a reactor vessel located to the side of the regeneration zone. The reactor vessel houses a reaction zone which is located adjacent to the regeneration vessel and a stripping vessel located subadjacent to the reaction zone. It is anticipated that this method of conversion will accompany the addition of a new reactor vessel located to the side of the existing reactor vessel and regeneration vessel. Therefore, the utilization of this invention will usually be accompanied by an increase in the feed processing capacity of the final FCC configuration. As a result, this invention will be generally applicable to any side by side FCC arrangement, as further described herein, provided the addition of a new reactor vessel is also possible.

Figure 1:
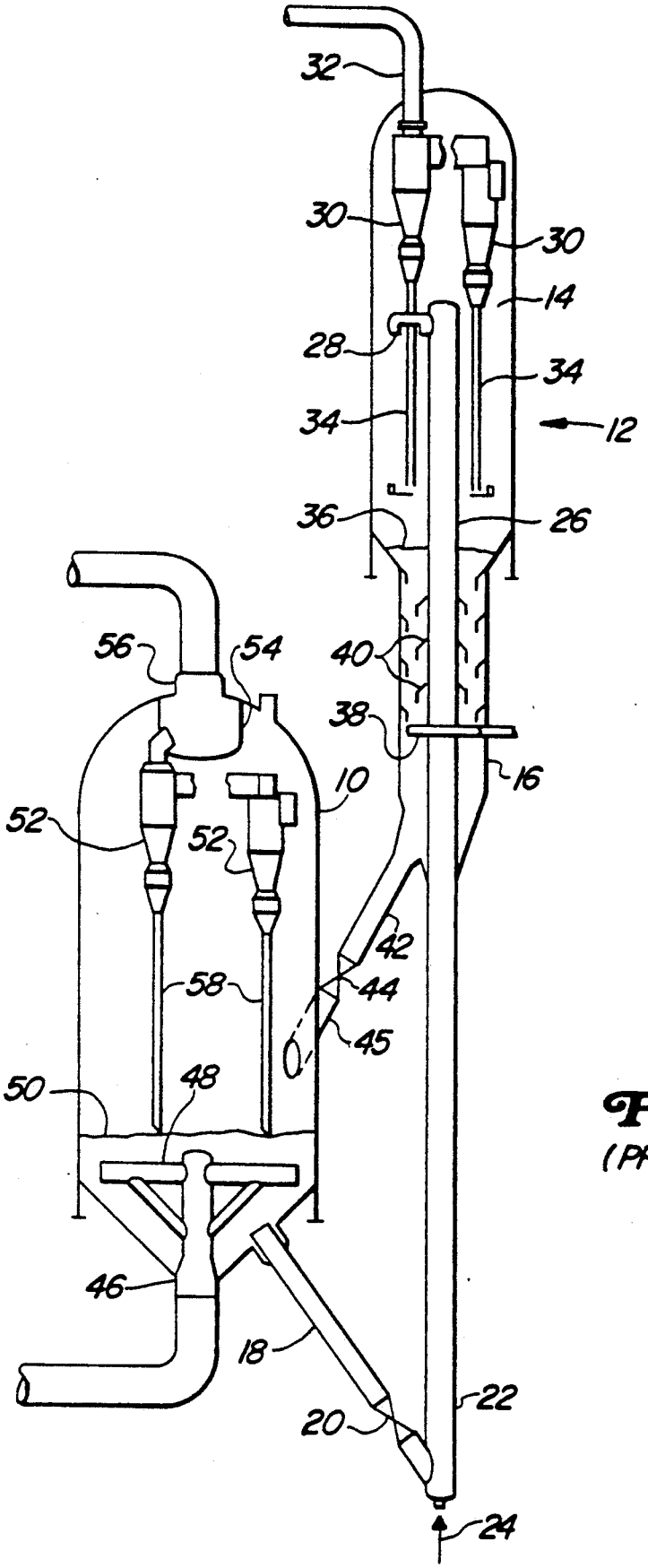
Fig. 1 (PRIOR ART)
FIG. 1 is an elevation view of a side by side reactor/regenerator arrangement before modification in accordance with this invention.

Reference is now made to FIG. 1 in order to show the type of side by side FCC configuration to which the method of this invention may be applied. Looking then at FIG. 1, a traditional side by side FCC arrangement will have a regeneration vessel 10, a reactor vessel 12 having a reaction zone 14 and a subadjacent spent catalyst stripping zone 16. A regenerated catalyst conduit 18 transfers catalyst from the regenerator through a control valve 20 and into a riser conduit 22 where it contacts an FCC feedstock entering the riser through feed conduit 24. Conduit 24 may contain a fluidizing medium such as steam which is added with the feed. Expanding gases from the feed and fluidizing medium convey catalyst up the riser and into an internal riser conduit 26. As the catalyst and feed pass up to the riser, the hydrocarbon feed cracks to lower boiling hydrocarbon products. Although an internal riser is shown in a section of this reactor, it is not necessary to the practice of this invention. A number of side by side FCC arrangements utilize a totally external riser with only an upper end that passes through the wall of reactor vessel 12 and into reaction zone 14. Riser 26 discharges the catalyst and hydrocarbon mixture through an opening 28 to effect an initial separation of catalyst and hydrocarbon vapors. Outside opening 28, a majority of the hydrocarbon vapors continue to move upwardly into the inlet of a cyclone separator 30 which effects a near complete removal of catalyst from the hydrocarbon vapors. Separated hydrocarbon vapors exit reaction zone 12 through an overhead conduit 32 while dip leg conduits 34 return separated catalyst to a lower portion of the reaction zone 14. Catalyst from riser outlet 28 and dip leg conduits 34 collect in a lower portion of the reaction zone forming a bed of catalyst having an upper surface 36. Bed 36 supplies catalyst to stripping zone 16. Steam entering stripping zone 16 through a conduit 38 rises countercurrent to a downward flow of catalyst through the stripping zone thereby removing sorbed hydrocarbons from the catalyst which are ultimately recovered with the steam by cyclone separators 30. In order to facilitate hydrocarbon removal, a plurality of downward sloping baffles 40 are provided in the stripping zone 16. A spent catalyst conduit 42 removes catalyst from a lower section of the stripping zone. A control valve 44 regulates the flow of catalyst through conduit 42.

The outlet of control valve 44 directs catalyst into a nozzle 45 that is located on the shell of regeneration vessel 10. Regeneration gas, which comprises an oxygen-containing gas such as compressed air, enters regenerator 10 through a conduit 46. As air distributor 48 dispersed air over the cross-section of regenerator 10 where it contacts spent catalyst from nozzle 45 in a dense catalyst bed having an upper surface 50. Coke is removed from the catalyst in the bed by combustion with oxygen from distributor 48. Combustion by-products and unreacted air rise upwardly along with entrained catalyst through the regenerator into the inlets of cyclones 52. Relatively catalyst-free gas collects in an internal chamber 54 which communicates with a gas conduit 56 for removing spent regeneration gas from the regenerator. Catalyst separated by the cyclones 52 drops from the separators through dip leg conduits 58 and returns to the dense bed in the regenerator.

The catalyst and hydrocarbon mixture entering the reactor vessel through outlet 28 usually will have a temperature of less than 535° C. (1000° F.). For this reason the shell of the reactor vessel typically comprises an unlined carbon steel or low chrome material. Similarly, internal equipment within the regenerator vessel and stripper, such as cyclone separators 30, internal riser 26 and baffles 40, have a similar metallurgy. Thus, as usually encountered, the reactor and stripper vessels along with the internals cannot be used for a second stage of regeneration which is carried out at temperatures above 535° C. (1000° F.). Accordingly, without modification to withstand higher temperatures, the reactor vessel is unsuitable for the second stage of regeneration in a two-stage regeneration process.

Regeneration vessel 10 will typically have a refractory lined metal shell which is capable of withstanding temperatures within the regenerator in excess of 850° C. (1500° F.). Thus, the regenerator vessel itself is suitable for high operating temperatures. However, other major equipment within the regenerator, including cyclone separators 52 and the air distribution device 48, may be unsuitable for high temperature operation. As a result, it may be possible to use the internal regeneration equipment in the first stage of a two-stage regeneration process which normally operates at a lower temperature.

Figure 2:
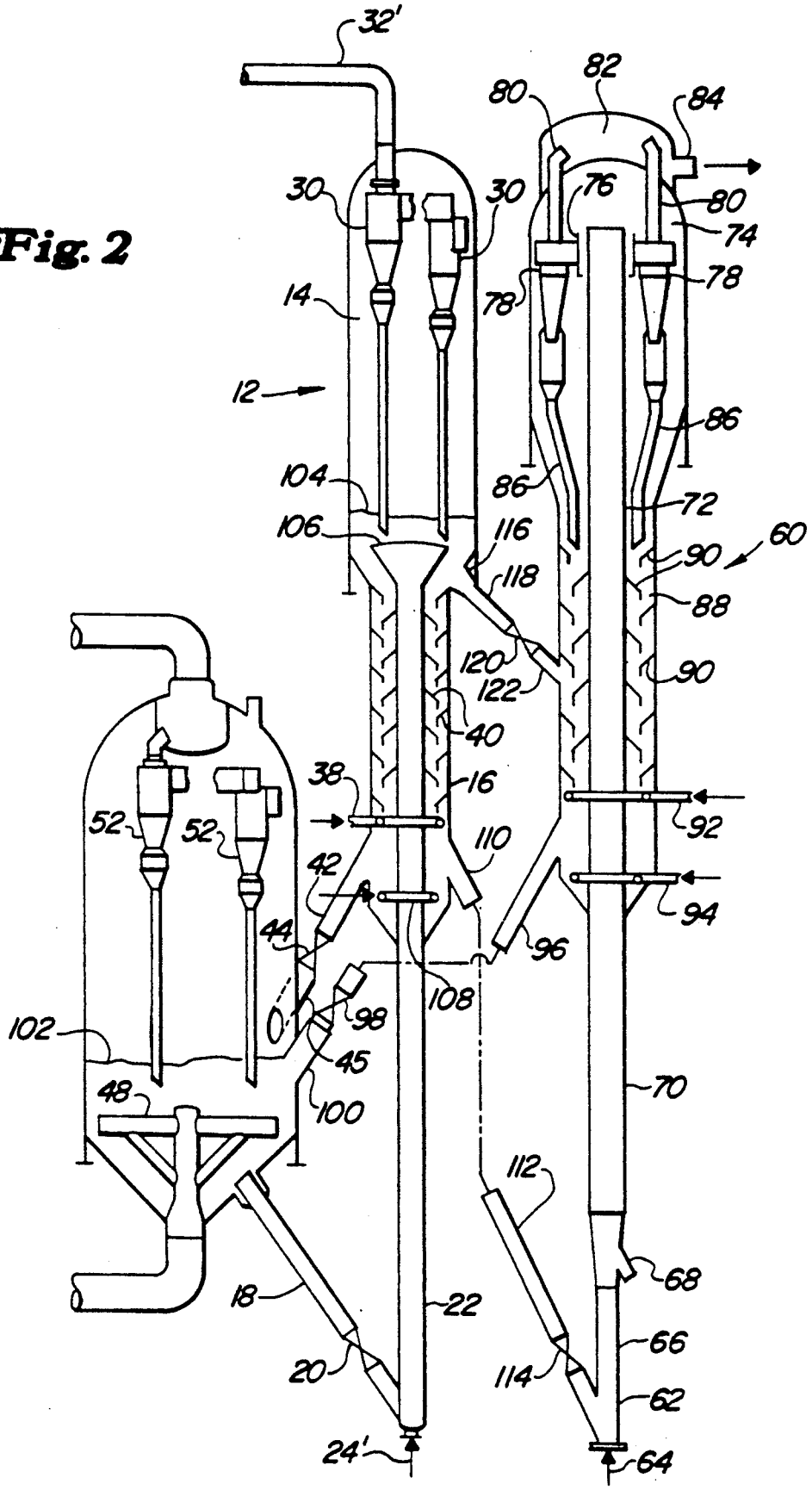
FIG. 2 is a section elevation of an FCC configuration including a side by side FCC arrangement modified in accordance with this invention.

Looking then at FIG. 2, the side by side arrangement of FIG. 1 is shown in modified form as part of the three-stage regeneration system for a new FCC arrangement. (In FIG. 2, the same reference numerals are used to refer to the equipment previously described for the existing regenerator and reactor vessels unless a component has changed in shape of configuration.) The three-stage configuration has a new reactor vessel 60 that is in side by side relationship with vessels 12 and 10. Reactor 60 is arranged for a riser cracking type operation which is well known to those skilled in the art. In this operation, regenerated catalyst enters a wye section 62 where it contacts a lift gas entering the wye section through a pipeline 64. The lift gas accelerates the catalyst and transfers it along a riser 66 to a downstream section where it is contacted with an FCC feed that enters the riser through a nozzle 68. Expanding hydrocarbon vapors, and in some cases additional fluidizing medium which may enter through nozzle 68, carry the catalyst upward through a remaining portion 70 of the external riser and into an internal riser 72.

Internal riser 72 discharges the mixture of catalyst and hydrocarbon vapors directly out of the end of the riser into a collection zone 74 to effect a ballistic separation of the relatively dense catalyst particles from the hydrocarbon vapors. There is no requirement that any particular type of separation device be used at the end of the riser as catalyst and product vapors are discharged therefrom. Other arrangements, such as directly coupled cyclones or downwardly directed arms, as previously discussed for reactor 12, may also be used. Hydrocarbon vapors flow into an annular collector 76 that surrounds the upper end of riser 72. Product vapors and small amounts of catalyst particles flow into cyclone separators 78 which have inlets in communication with collector 76. Cyclone separators 78 separate catalyst and hydrocarbon vapors in the manner previously described for reactor vessel 12. Hydrocarbon vapors are carried overhead by conduits 80 that discharge into a vapor collection chamber 82. A product vapor line 84 withdraws product vapors from collection chamber 82. Catalyst from cyclone separator 78 flows downwardly through dip pipes 86 where it is discharged into a stripping zone 88 that receives catalyst from the dip legs as well as catalyst discharged directly from the riser.

Stripping zone 88 contains a plurality of vertically spaced baffles 90 over which the catalyst passes as it moves downwardly through the stripping zone in countercurrent contact with stripping steam that enters a lower portion of the stripping zone through a distributor ring 92. A secondary distributor ring 94 is provided below stripping ring 92 in order to keep catalyst in the lowermost portion of stripping zone 88 completely fluidized so it can flow freely out of the stripping zone. Lower stripping ring 94 may receive either steam or an inert fluidizing gas. Catalyst from the bottom of the stripping zone 88 which now contains between 0.05 and 2 wt. % coke is returned to the regeneration vessel 10 via a catalyst conduit at a rate regulated by control valve 98.

Reactor vessel 60 and the equipment attached thereto now replace the function of reactor vessel 12 so that this vessel and the rest of the side by side reactor/regenerator arrangement may be modified in accordance with this invention to provide additional regeneration capacity and flexibility. For a typical side by side arrangement, addition of the reactor and conversion of the existing vessels will generally provide a 20–60% increase in feed capacity. FIG. 2 also shows the modifications to the side by side reactor/regeneration arrangement which, starting with the regenerator, include the previously described addition of conduit 96 and control valve 98 to transfer spent catalyst from the stripping zone 88 to the regeneration vessel 10 which now operates as a first-stage regeneration zone. Control valve 98 is attached to a new catalyst inlet nozzle 100 which discharges spent catalyst into a dense bed having an upper surface 102. A new catalyst inlet nozzle will be necessary since nozzle 45 is still directed towards the old reactor vessel and the space occupied thereby. Since the new reactor 60 occupies a different space than old reactor vessel 12, proper orientation of the catalyst conduit 96 requires a new nozzle 100. Apart from the addition of nozzle 100, regenerator 10 can operate as a first stage of regeneration in substantially the same manner as it did in the previously described side by side arrangement.

Preferably, the first stage of regeneration is operated in a partial CO combustion mode. In this type of operation, the first stage of regeneration will remove about 50–90% of the coke on the entering spent catalyst. In order to reduce operating temperatures and oxygen requirements, the first regeneration stage may perform only a partial oxidation of the carbon monoxide produced during coke combustion. The resulting lower temperatures and lower air addition requirements from this type of operation will facilitate the use of existing equipment within some regenerators. In regenerators where the cyclone separators 52 and air distribution device 48 are made of low alloy metal, lower regenerator temperatures, particularly those below 650° C. (1200° F.), will prolong the operating life of these materials. In addition, the air distribution device may be designed for air flow rates which are too low to supply the total oxygen demands that would be necessary to combust all of the coke and carbon monoxide in regeneration vessel 10. However, since the first-stage regeneration zone only uses between 30–70% of the air required for complete coke and CO combustion, air distribution device 48 may be suitable for the first stage of regeneration without substantial modification.

Catalyst is again withdrawn by regenerated catalyst conduit 18 at a rate determined by control valve 20. However, in this case, the catalyst entering riser conduit 22 is only partially regenerated. An oxygen containing gas, in this case air, entering the riser 22 through a conduit 24' contacts the partially regenerated catalyst in the bottom of riser 22 to transport catalyst up the riser. In addition, the air added at this point will initiate further combustion of coke from the catalyst particles. In this manner, riser 22 can function as an additional regeneration zone. Nevertheless, the primary function of the riser 22 is the transport of the catalyst particles upward through riser 22 and into zone 14 which now functions as a second-stage regeneration zone. An air distribution device is provided for injecting air from line 24' into riser 22. This device can consist of a simple open pipe, or for a very large riser, the distribution device can comprise multiple outlets spaced over the inside diameter of riser 22. Since the temperature of the partially regenerated catalyst entering line 18 and the lower portion of riser 22 will normally be as low or lower than the temperature of the catalyst that entered this region before conversion of the unit, the existing components may be suitable for the use in the three-stage configuration. As combustion of coke and coke by-products continues with movement of the catalyst up the riser, the upper portion of the riser 22 will have equal or higher operating temperatures relative to the lower portion of riser 22. This temperature situation is opposite to what occurs when upper vessel 12 is used as a reactor and temperatures fall as the catalyst rises. Therefore, the existing upper portion of conduit 20 may not be suitable for the higher temperatures (usually above 650° C. (1200° F.)) associated with complete regeneration of the catalyst. Accordingly, it may be necessary to replace the upper portion of line 22 with a pipe section made of higher metallurgy such as stainless steel or having internal thermal insulation. In the alternative, the metal temperature of riser 22 can be reduced by removing external insulation thereby permitting convection cooling of the pipe surface.

The former reaction zone of vessel 12 functions as a disengaging vessel and a second-stage regeneration zone. The upper section of vessel 12 can be operated as a combustion zone when unconverted coke or coke by-products enter the upper section of vessel 12 with catalyst from riser 22. A dense bed having an upper surface 104 is maintained in the upper section of vessel 12 and receives catalyst from riser 22. Preferably the catalyst and gas leaving riser 22 are distributed over the entire cross-section of the second regeneration zone. For this purpose, the uppermost section of internal riser 22 is removed to make room for a catalyst and gas distributor 106 that is located at the upper end of the riser reaction zone. Spent regeneration gas and entrained catalyst travel upward from the top 104 of the dense bed and enter cyclone separators 30 where gas is separated from the catalyst and recovered overhead by conduit 32' while catalyst particles are returned to the dense bed. Due to the higher temperatures associated with the complete regeneration operation, cyclone separator 30 is replaced with a new cyclone separator made of stainless steel material.

Catalyst in the second regeneration zone will have a somewhat reduced coke content from that of the catalyst first entering the first regeneration zone. Catalyst entering the riser 22 can have an average concentration of coke equal to 0.1 to 0.15 wt. %. As mentioned previously, some degree of coke combustion will occur in the transport of the catalyst up the riser 22. The top level 104 of the bed in the second regeneration zone can be adjusted to regulate the residence time in the second catalyst regeneration zone and adjust the amount of coke combustion that takes place therein. In addition to controlling residence time, the degree of coke and CO combustion that takes place in the second regeneration zone will also be controlled by the amount of oxygen that enters the zone from the riser conduit 22 and from the lower section of the regeneration vessel.

The final stage of regeneration takes place in the lower section of vessel 12. The stripping section 16 now functions as a third regeneration zone. As catalyst passes around distributor 106 and into section 116, it passes back and forth across vertically spaced baffles 40. An oxygen-containing gas, usually air, is distributed through pipe ring 38 and flows upwardly in countercurrent contact with the catalyst. This countercurrent contact of the air with the catalyst is highly effective in completely removing coke from the catalyst. Complete removal of coke from catalyst requires a high concentration of oxygen. The countercurrent contact of the air with the catalyst allows a very high concentration of oxygen to be provided in the lower section of zone 16. This high concentration of oxygen cannot normally be provided in a regeneration zone without providing a large excess oxygen concentration in the flue gas. However, by cascading the catalyst through the final stage of the regeneration in countercurrent contact with the regeneration gases, the large quantity of oxygen added at the lower portion of the third-stage regeneration is reacted as the regeneration gas flow upwardly through the long regeneration zone. Therefore, the addition of the oxygen-containing gas can be controlled so that essentially all of the oxygen is consumed before the regeneration gas passes out of the dense phase portion of the third and second regeneration zones. At the very bottom of the third-stage regeneration zone, an additional distribution ring • maintains fluidization of the catalyst by the introduction of additional regeneration gas or an inert gas. A new outlet nozzle 110 in the bottom of the third regeneration zone transfers catalyst through a regenerated standpipe 112 at a rate regulated by control valve 114 to supply the regenerated catalyst to the wye section as previously described.

The lower section of regeneration zone 16 may operate at a much higher temperature than the previous stripper section when vessel 12 was used as a reactor. The presence of the vertically spaced baffles along the inside wall in zone 16 makes it difficult to internally insulate the section of the vessel and allow its continued use. Therefore, the typical carbon steel, or 1¼ chrome metallurgy, in the lower section of vessel 12, will require special insulation or replacement with stainless steel metallurgy. In many cases, replacement of the external shell of lower zone 16 with stainless steel will not be practical unless the upper portion of vessel 12 is also replaced with stainless steel. Differences in thermal expansion between stainless steel and low chrome, or carbon steel, may make the use of stainless steel for only the lower section of vessel 12 an unacceptable design choice. Therefore, it is usually best to use some form of internal lined section for the shell of the third regeneration zone. Conversely, the continual exposure of the internal baffles to high temperatures in a relatively oxygen-rich environment, will normally require the use of high metallurgy baffles.

The former spent catalyst standpipe 42 may be used in conjunction with nozzle 45 to transfer hot catalyst from the bottom of the third regeneration zone into the first regeneration zone to raise the temperature of the dense catalyst bed and control the initiation of coke combustion in the first regeneration zone.

An additional benefit of the arrangement that results from the addition of new reactor vessel 60 is a relative elevation between the second-stage regeneration zone and the stripping zone 88 that facilitates the use of partially regenerated catalyst for raising the temperature of the catalyst stripping zone. FIG. 2 also shows a catalyst outlet nozzle 116 and a lower portion of the second-stage regeneration zone 14. Nozzle 116 withdraws partially regenerated catalyst that is transferred through a conduit 118 at a rate regulated by a control valve 120 into the middle of catalyst stripping zone 88 through a catalyst inlet nozzle 122. Partially regenerated catalyst from the lower portion of the second regeneration zone will have a temperature in the range of 1200°-1450° F. Spent catalyst that enters the top of stripping zone 88 is usually at a temperature of from 875°-1000° F. Typically, the temperature of the partially regenerated catalyst is as least 180° F. (100°C.) higher than the temperature of the catalyst that enters the stripping zone. Mixture of the two catalyst streams will raise the average temperature in stripping zone 88 to promote a more complete desorption of hydrocarbons from the spent catalyst particles. The use of partially regenerated catalyst has the advantage of minimizing damage to the catalyst from the regenerator that enters the stripping zone and reducing the possibility that desorbed hydrocarbons in the stripping zone will be re-adsorbed on the regenerated catalyst.

It is often difficult to transfer partially regenerated catalyst to the stripping zone in most FCC arrangements. In most arrangements, the source of partially regenerated catalyst is located at a lower elevation than the stripping zone. Therefore, it would be necessary to transport partially regenerated catalyst upwardly into the stripping zone. The arrangement that results from the method of this invention provides a second stage of regeneration that is located well above the mid point of the stripping zone. As a result, partially regenerated catalyst is available at a higher elevation and can be transferred into the stripping zone using only a simple catalyst standpipe and control valve.

The description of this invention in the context of specific embodiments is not meant to limit the scope of this invention to those embodiments shown herein. In particular, the suggested reuse of various existing items of equipment such as cyclones, air distributors and catalyst lines are not intended to limit the scope of this invention to a conversion that makes use of specific items apart from the regenerator vessel, reactor vessel, and stripper vessel.

I claim:

1. In a method of improving a side by side reactor/regenerator arrangement by converting the side by side reactor/regenerator arrangement into a three-stage regenerator, said side by side reactor/regenerator arrangement having a regenerator vessel, a first reactor located to the side of the regenerator vessel, an external conduit for transporting catalyst from a lower portion of said regenerator vessel to a riser conduit, said riser conduit transporting said catalyst from said external conduit to said first reactor vessel, means for adding spent catalyst to said regenerator vessel, means for recovering regeneration gas from an upper portion of said regenerator vessel and a stripping vessel subadjacent to and in open communication with said reactor vessel, said improvement comprising:

(a) providing said side by side reactor/regenerator arrangement;

(b) providing means for distributing catalyst across a lower portion of said reactor vessel and providing a cyclone separator to recover regeneration gas from the upper end of said reactor vessel to modify said reactor vessel to function as a second-stage regeneration vessel;

(c) installing means for distributing an oxygen-containing gas into a lower portion of said stripping vessel and providing a withdrawal conduit for withdrawing catalyst from said stripping vessel to modify said stripping vessel to function as a third-stage regeneration vessel.

2. The method of claim 1, further comprising:

positioning a second reactor vessel next to said first reactor vessel and said regenerator vessel, wherein said withdrawal conduit of said third-stage regeneration vessel transports catalyst from said third-stage regeneration vessel to a second riser conduit, said second riser conduit transporting said catalyst from said withdrawal conduit to said second reactor vessel, said second reactor vessel having a second stripping vessel subadjacent to and in open communication with said second reactor vessel, the bottom of said second stripping vessel communicating with said means for adding spent catalyst to said regenerator vessel.

* * * * *